US009530587B2

(12) United States Patent
Kokubu

(10) Patent No.: US 9,530,587 B2
(45) Date of Patent: Dec. 27, 2016

(54) SWITCH DEVICE

(71) Applicant: Valeo Japan Co., Ltd., Saitama (JP)

(72) Inventor: Taito Kokubu, Tokyo (JP)

(73) Assignee: Valeo Japan Co., Ltd. (JP)

( * ) Notice: Subject to any disclaimer, the term of this patent is extended or adjusted under 35 U.S.C. 154(b) by 0 days.

(21) Appl. No.: 14/937,589

(22) Filed: Nov. 10, 2015

(65) Prior Publication Data

US 2016/0133401 A1 May 12, 2016

(30) Foreign Application Priority Data

Nov. 10, 2014 (JP) ..... 2014-227842

(51) Int. Cl.

| | |
|---|---|
| ***H01H 13/14*** | (2006.01) |
| ***H01H 9/30*** | (2006.01) |
| ***H01H 23/16*** | (2006.01) |
| *H01H 1/18* | (2006.01) |

(52) U.S. Cl.

CPC ..... *H01H 9/30* (2013.01); *H01H 13/14* (2013.01); *H01H 23/168* (2013.01); *H01H 1/18* (2013.01); *H01H 2205/002* (2013.01)

(58) Field of Classification Search

CPC ..... H01H 2071/042; H01H 2215/008; H01H 23/04; H01H 23/145; H01H 71/082

See application file for complete search history.

(56) References Cited

U.S. PATENT DOCUMENTS 3,371,179 A 2/1968 Lohr
5,073,764 A * 12/1991 Takahashi ..... H01H 1/2066 218/147
5,584,380 A * 12/1996 Naitou ..... H01H 23/145 200/315
6,166,345 A * 12/2000 Ito ..... H01H 5/045 200/437
6,683,265 B2 * 1/2004 Masuda ..... H01H 13/48 200/406

(Continued)

FOREIGN PATENT DOCUMENTS

| | | |
|---|---|---|
| EP | 1081730 A2 | 3/2001 |
| JP | S6-17055 B2 | 5/1994 |

OTHER PUBLICATIONS

European Search Report for App. No. 15191539.4 dated Mar. 15, 2016, 3 pp.

*Primary Examiner* — Truc Nguyen

(74) *Attorney, Agent, or Firm* — Fishman Stewart PLLC

(57) ABSTRACT

A switch device may have a restriction member provided between a support portion and a fixed contact point portion of a polar board for restricting movement of a movable piece to the polar board. The restriction member may have a set height from the polar board such that the restriction member abuts on the movable where the fixed contact point reaches a predetermined height from the polar board due to wear. The movable piece may be supported by the support portion to be displaceable in the longitudinal direction such that when one side of the movable piece makes contact with the first fixed contact point, in a case where the restriction member makes contact with the movable piece, the movable piece may be displaced in the longitudinal direction on a basis of the contact position with the restriction member to be disconnected from the first fixed contact point.

8 Claims, 7 Drawing Sheets

(56) References Cited

U.S. PATENT DOCUMENTS

| | | | | |
|---|---|---|---|---|
| 7,262,374 | B2 * | 8/2007 | Takatsuka | G06F 3/0202 200/5 A |
| 7,285,740 | B2 * | 10/2007 | Nakajima | H01H 23/145 200/339 |
| 8,188,389 | B2 * | 5/2012 | Ogura | H01H 15/04 200/16 A |
| 8,558,127 | B2 * | 10/2013 | Blakely | H01H 35/343 200/83 R |
| 8,575,506 | B2 * | 11/2013 | Kitahara | H01H 13/06 200/302.2 |

* cited by examiner

SWITCH DEVICE

CROSS-REFERENCE TO RELATED APPLICATIONS

This application claims priority to Japanese Patent Application No. 2014-227842, filed on Nov. 10, 2014, the disclosure of which is incorporated by reference herein.

TECHNICAL FIELD

The present invention relates to a structure of a switch device.

BACKGROUND

Japanese Utility Model Laid-Open Publication No. 06-17055 discloses a switch device in which a button is pushed down or the pushed button is released to switch an electrical contact state between a movable contact point and a fixed contact point.

FIGS. 7 A to 7C are views explaining a switch device 500 according to a conventional example. FIG. 7A is a sectional view illustrating a state before wear of contact points and pushing down a button. FIG. 7B is an enlarged view of an area A in FIG. 7A illustrating a state having pushed down a button and before wear of contact points. FIG. 7C is an enlarged view of an area A in FIG. 7A illustrating a state having pushed down a button and after wear of contact points.

In the switch device 500, metallic movable contact points 530 provided on one end side of a button unit 520 and metallic fixed contact points 540 provided in a bottom wall 511 of a case member 510 are arranged to face to each other in a contact point accommodation chamber S of the case member 510 (refer to FIG. 7A).

The button unit 520 is urged in a direction of being away from the fixed contact points 540 along a center axis X1 of the button unit 520 by a spring member 550. When an operating button 522 provided on the other end side of the button unit 520 is pushed down against an elastic force of the spring member 550, the movable contact points 530 make contact with the fixed contact points 540 (switch-on) or when the pushed operating button 522 is released, the movable contact points 530 are disconnected from the fixed contact points 540 by the elastic force of the spring member 550 (switch-off).

Here, the metallic fixed contact point 540 is worn away due to arc electric discharge generated between contact points for every time of switching on/off or due to contact with the movable contact point 530. The switch device 500 is provided with stoppers 512 to prevent a state where when the amount of wear of the fixed contact point exceeds a predetermined value, the movable contact point and the fixed contact point adhere to each other, which causes a large current to continue to flow therebetween.

That is, the switch device 500 is provided with the plastic stopper 512 in a position closer to the center axis X1 than the fixed contact point 540 on the bottom wall 511 of the case member 510.

When the amount of wear of the fixed contact point is equal to or less than the predetermined value, a gap L1 between the fixed contact point 540 and the movable contact point 530 is set to be narrower than a gap L2 between the stopper 512 and the movable contact point 530. Therefore upon pushing down the operating button 522, the movable contact point 530 makes contact with the fixed contact point 540 prior to making contact with the stopper 12 to switch on (refer to FIG. 7B).

When the gap L1 between the fixed contact point 540 and the movable contact point 530 becomes approximately equal to the gap L2 between the stopper 512 and the movable contact point 530 as a result of the wear of the fixed contact point 540, the movable contact point 530 abuts on the plastic stopper 512 to stop.

Since the movable contact point 530 makes contact with the fixed contact point 540 as well in this state (refer to FIG. 7C), it is difficult to prevent the state where the movable contact point 530 and the fixed contact point 540 adhere to each other, which causes a large current to continue to flow therebetween.

Therefore, when the amount of wear of the fixed contact point exceeds the predetermined value, it is required that the movable contact point does not make contact with the fixed contact point certainly.

SUMMARY

Accordingly, the present invention is made in view of the above-described problems, and an object of the present invention is to provide a switch device which can prevent a movable contact point from making contact with a fixed contact point when the amount of wear of the fixed contact point exceeds a predetermined value.

According to an aspect of the present invention, there is provided a switch device in which:

a band-shaped movable piece is supported in a position of being separated from an opposing face of a polar board to the movable piece by a support portion of the polar board for supporting a midway position of the movable piece in the longitudinal direction, the movable piece being provided to be capable of swinging in a direction where one side and the other side of the movable piece in the longitudinal direction are connected to or disconnected from a first fixed contact point and a second fixed contact point formed to be projected toward the movable piece from the opposing face of the polar board; and a movable board provided with an urging member for urging the movable piece to the polar board is provided to be capable of moving forward/backward in the longitudinal direction in association with an operation of knob, wherein when the movable board moves to the one side in the longitudinal direction, the urging position of the movable piece by the urging member is displaced to the one side in the longitudinal direction to cause the one side of the movable piece in the longitudinal direction to make contact with the first fixed contact point, and when the movable board moves to the other side in the longitudinal direction, the urging position of the movable piece by the urging member is displaced to the other side in the longitudinal direction to cause the one side of the movable piece in the longitudinal direction to be disconnected from the first fixed contact point, characterized in that a restriction member is provided between the support portion of the polar board and the first fixed contact point to restrict the movement of the movable piece to the polar board, a height of the restriction member from the polar board being set to a height in such a manner as to abut on the movable piece in a point where a height of the first fixed contact point from the polar board reaches a predetermined height due to wear, and in the support portion, the movable piece is supported to be displaceable in the longitudinal direction of the movable piece, wherein when the one side of the movable piece makes contact with the first fixed contact point, in a case where the restriction member makes contact with the movable piece, the movable piece is displaced in the longitudinal direction on a basis of the contact position with the restriction member to be disconnected from the first fixed contact point.

According to the aspect of the present invention, even if the first fixed contact point is worn away due to repetition of connection and disconnection between the one side of the movable piece in the longitudinal direction and the first fixed contact point by an operation of the switch device, the restriction member provided between the support portion of the polar board and the first fixed contact point restricts the movement of the one side of the movable piece to the polar board in a point where the height of the worn first fixed contact point from the polar board reaches the predetermined height, and the movable piece moves in the direction of being disconnected from the first fixed contact point in the longitudinal direction. Therefore, when the amount of wear of the first fixed contact point exceeds the predetermined value, it is possible to prevent the movable piece from making contact with the first fixed contact point.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION

Hereinafter, a switch device 1 according to a first embodiment in the present invention will be in detail explained with reference to the accompanying drawings.

Figure 1A:
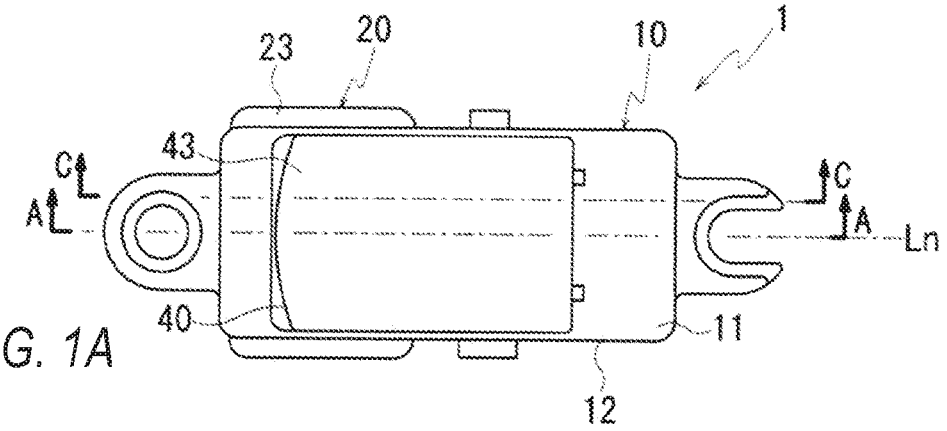
FIG. 1A is a plan view illustrating a switch device according to a first embodiment in the present invention.
Figure 1B:
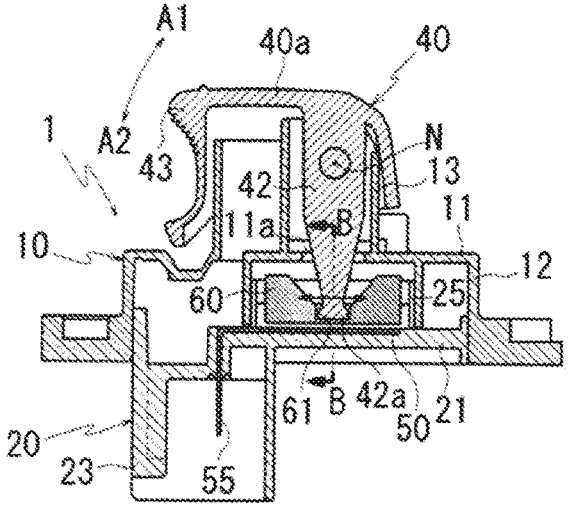
FIG. 1B is a sectional view taken in a direction of arrows A-A in FIG. 1A.

FIG. 1A and FIG. 1B are views explaining the switch device 1 according to the first embodiment. FIG. 1A is a plan view illustrating a switch device according to a first embodiment in the present invention. FIG. 1B is a sectional view taken in a direction of arrows A-A in FIG. 1A.

Figure 2A:
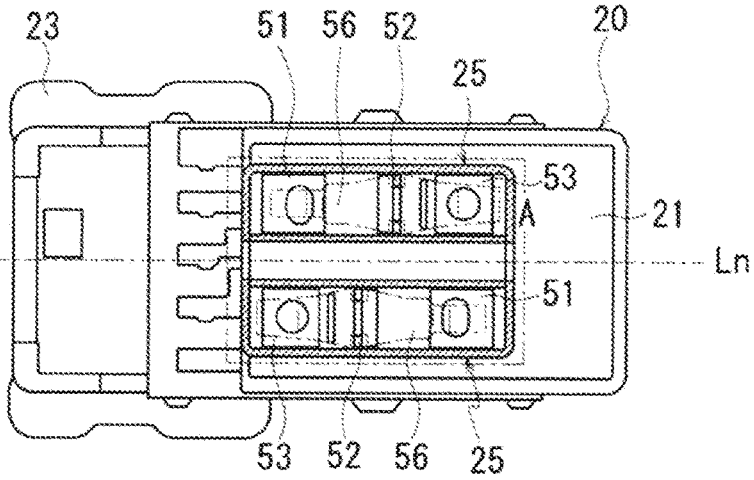
FIG. 2A is a plan view illustrating a polar board according to the first embodiment.
Figure 2B:
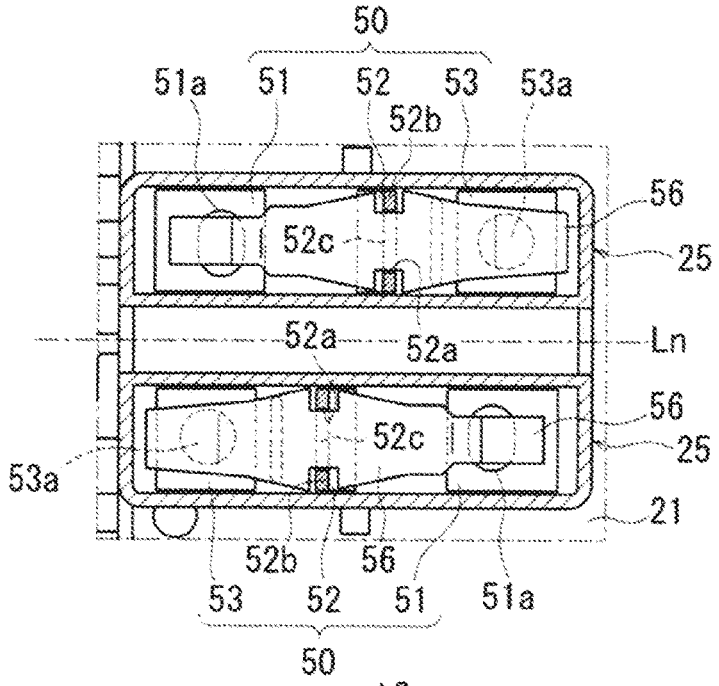
FIG. 2B is an enlarged view illustrating an area A in FIG. 2A.
Figure 2C:
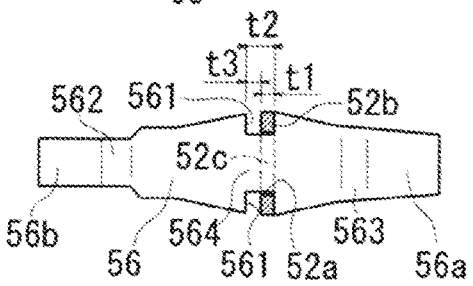
FIG. 2C is a view explaining a relation between a movable piece and a support portion according to the first embodiment.

FIGS. 2A to 2C are views explaining a polar board 20 according to the first embodiment. FIG. 2A is a plan view illustrating a polar board according to the first embodiment. FIG. 2B is an enlarged view illustrating an area A in FIG. 2A. FIG. 2C is a view explaining an engagement relationship between a movable piece 56 and an engagement portion 52*a* of a support portion 52.

It should be note that in FIGS. 2A to 2C, a position of a peripheral wall portion 25 surrounding the periphery of the movable piece 56 is hatched for easy understanding.

Figure 3B:
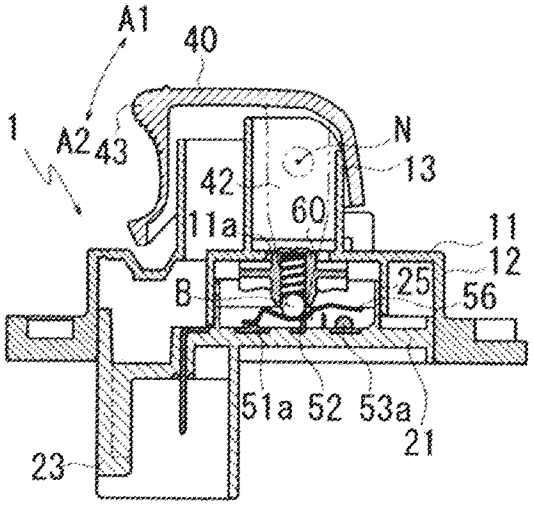
FIG. 3B is a sectional view taken in a direction of arrows C-C in FIG. 1A.
Figure 3C:
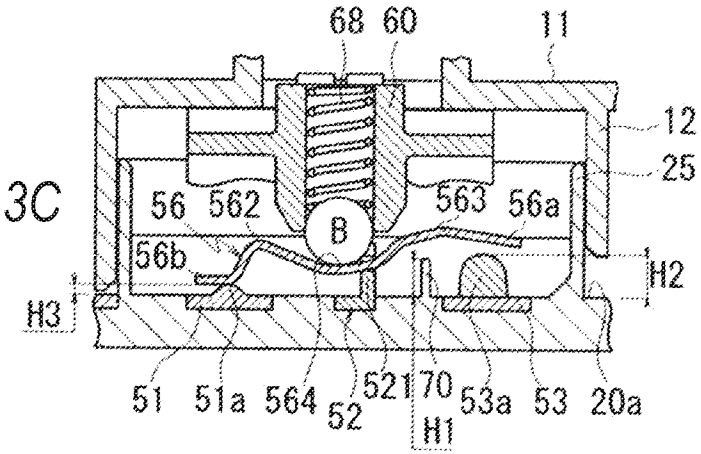
FIG. 3C is an enlarged view explaining the periphery of a slider in FIG. 3B.
Figure 3A:
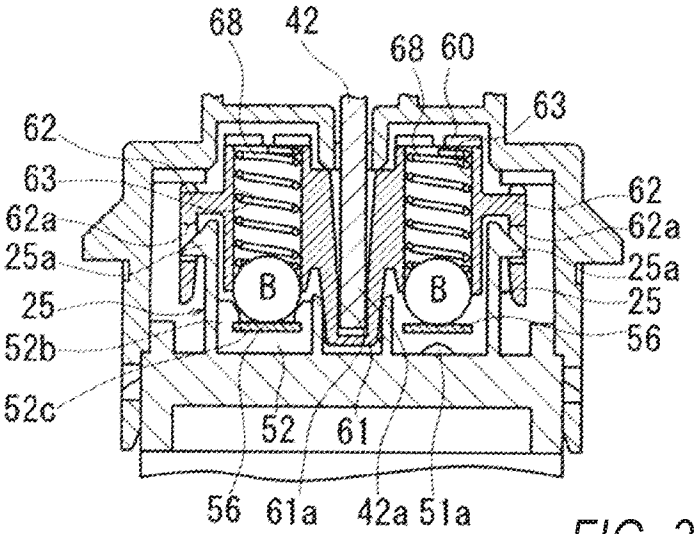
FIG. 3A is a sectional view taken in a direction of arrows B-B in FIG. 1B.

FIGS. 3A to 3C are views explaining the structure of the switch device 1. FIG. 3A is a sectional view taken in a direction of arrows B-B in FIG. 1B. FIG. 3B is a sectional view taken in a direction of arrows C-C in FIG. 1A. FIG. 3C is an enlarged view explaining the periphery of a slider in FIG. 3B.

As illustrated in FIGS. 1A and 1B, the switch device 1 has the polar board 20 in which fixed contact points 50 (fixed contact points 51, support portions 52 and fixed contact points 53 illustrated in FIGS. 2A and 2B) are provided, a case 10 covering an upper surface of the polar board 20, and a knob 40 swingably supported by the case 10.

The case 10 has a wall portion 11 formed in an oblong shape in plan view and a peripheral wall portion 12 surrounding a peripheral edge of the wall portion 11 over an entire circumference thereof, and the case 10 is assembled in the polar board 20 by fitting the peripheral wall portion 12 in an outer periphery of the polar board 20.

As illustrated in FIGS. 2A and 2B, the polar board 20 has a base portion 21 formed in a rectangular shape in plan view, and a tubular connector 23 is provided on one end side of the base portion 21 in the longitudinal direction (center line Ln direction) to surround a plurality of connector terminals 55 (refer to FIG. 1B) extending in a vertical direction of the base portion 21.

Peripheral wall portions 25 formed in a rectangular shape in plan view are provided in an approximately central portion of the base portion 21 in the longitudinal direction to extend upward of the polar board 20 (hatching portions in FIGS. 2A and 2B).

The peripheral wall portions 25 are provided to be spaced from each other in the width direction (direction vertical to the center line Ln) of the base portion 21, and to be symmetric about a virtual line (the central line Ln) passing through the center of the width direction of the base portion 21.

The fixed contact point 51, the support portion 52 and the fixed contact point 53 are provided in order in the longitudinal direction along the center line Ln in each of the peripheral wall portions 25. As illustrated in FIG. 2B, the fixed contact point 51, the support portion 52 and the fixed contact point 53 are positioned in that order from the connector portion 23 side (left side in the figure) in the peripheral wall portion 25 positioned upward with respect to the center line Ln, and the fixed contact point 53, the support portion 52 and the fixed contact point 51 are positioned in that order from the connector portion 23 side (left side in the figure) in the peripheral wall portion 25 positioned downward with respect to the center line Ln.

The fixed contact point 51 is formed in a rectangular shape in plan view, and is provided with a fixed contact point portion 51*a* placed in an approximately central portion of the center line Ln in the longitudinal direction to be curved upward of the polar board 20. The fixed contact point portion 51*a* is formed in an elliptical shape in plan view, and is provided such that a long side of the ellipse is situated along a direction vertical to the center line Ln.

The fixed contact point 53 is formed in a rectangular shape in plan view, and is provided with a fixed contact point portion 53*a* placed in an approximately central portion of the center line Ln in the longitudinal direction to be curved upward of the polar board 20. The fixed contact point portion 53*a* is formed in a circular shape in plan view. A height H2 (refer to FIG. 3C) of the fixed contact point portion 53*a* from an upper surface 20*a* of the polar board 20 is set to be higher than a height H3 (refer to FIG. 3C) of the fixed contact point 51 from the upper surface 20*a* of the polar board 20 (H3<H2).

As illustrated in FIGS. 2A and 2B, the support portion 52 is provided between the fixed contact points 51, 53 in the center line Ln direction. The fixed contact point 53 side of the support portion 52 is bent at 90 degrees to extend upward of the polar board 20, and the support portion 52 is formed in an L-letter shape in sectional view.

The fixed contact point 53 side of the support portion 52 is formed as an engagement wall 52*b* linearly extending upward of the case 10-side from the upper surface 20*a* of the polar board 20, and a notch portion 52*c* is formed in the center portion in the width direction in a tip of the engagement wall 52*b* (refer to FIG. 2B).

Engagement portions 52*a* engaging to notch portions 561 of the movable piece 56 to be described later are formed on both sides of the engagement walls 52*b* about the notch portion 52*c*, and the movable piece 56 is designed to be swingably supported by the notch portion 52*c* of the engagement wall 52*b*.

As illustrated in FIG. 2C, the movable piece 56 is formed in a band shape in plan view, and the notch portions 561 are formed on both sides of the movable piece 56 in the width direction and in the midway position of the movable piece 56 in the longitudinal direction. The width t2 of the notch portion 561 in the longitudinal direction is set to be larger than the width t1 of the engagement portion 52*a* of the engagement wall 52*b* (t2>t1) as described above.

As a result, supporting the movable piece 56 by the engagement wall 52*b* allows a gap t3 (t3=t2−t1) to be formed between the notch portion 561 and the engagement wall 52*b*, and the movable piece 56 swingably supported by the engagement wall 52*b* can slide in the longitudinal direction (the center line Ln direction) by the gap t3.

One end of the movable piece 56 about the notch portion 561 is formed as an abutting potion 56*a* on the aforementioned fixed contact point 53 and the other end is formed as an abutting portion 56*b* on the aforementioned fixed contact point 51.

In plan view, the abutting portion 56*a* side of the movable piece 56 is formed to be narrower in width in a two-stage manner with being the farther from the notch portion 561.

As illustrated in FIG. 3C, when the switch device 1 is situated in a neutral position in which the knob 40 is not operated, the abutting portion 56*a* side of the movable piece 56 has a sectional shape in which a curved portion 563 formed in the midway position in the longitudinal direction is arranged in the farthest position from the polar board 20, and the abutting portion 56*a* closer to a tip side than the curved portion 563 is formed in a linear shape in sectional view.

As illustrated in FIG. 2C, in plan view, the abutting portion 56*b* side of the movable piece 56 is structured such that the width from the notch portion 561 to the abutting portion 56*b* is narrower in a stepwise manner with being farther from the notch portion 561 and thereafter the abutting portion 56*b* having an equal width is formed.

As illustrated in FIG. 3C, the abutting portion 56*b* side of the movable piece 56 is largely bent in a direction of being closer to the polar board 20 from the curved portion 562 formed in the midway position in the longitudinal direction, and thereafter becomes the abutting portion 56*b* having a linear section. When the switch device 1 is in a neutral position in which the knob 40 is not operated, the movable piece 56 is structured such that the abutting portion 56*b* is held in a contact state with the fixed contact point portion 51*a* of the fixed contact point 51.

The fixed contact point 51 on which the abutting portion 56*b* of the movable piece 56 abuts is connected (earthed) to unillustrated GND, and the fixed contact point 53 on which the abutting portion 56*a* of the movable piece 56 abuts is connected to an unillustrated power source.

As a result, when one end side of the movable piece 56 abuts on the fixed contact point portion 53*a*, the support portion 52 is conductive through the movable piece 56 to the fixed contact point 53, and when the movable piece 56 abuts on the fixed contact point portion 51*a*, the support portion 52 is conductive through the movable piece 56 to the fixed contact point 51.

It should be noted that the fixed contact point 51, the support portion 52 and the fixed contact point 53 are formed integrally with the base portion 21 of the polar board 20 by molding, and are exposed as the connector terminals 55 in the connector portion 23 (refer to FIG. 1B).

As illustrated in FIG. 1B, a knob support tube 13 formed in a rectangular shape in top view is formed integrally with the wall portion 11 in the case 10 in an approximately central portion in the longitudinal direction (left-right direction in the figure), and the knob 40 for operating the switch device 1 is located on an upper portion of the knob support tube 13 to be capable of swinging around a swinging axis N.

The knob 40 has a lever 42 extending in the downward side of the polar board 20 from the backside of a top portion 40*a* of the knob 40, and the swinging axis N is set in the midway portion of the lever 42.

The lever 42 extends in the downward side of the polar board 20 in the knob support tube 13, and a tip portion 42*a* of the lever 42 penetrates a through hole 11*a* penetrating the wall portion 11 of the case 10 in the thickness direction to be fitted in a fitting groove portion 61*a* of the slider 60 between the case 10 and the polar board 20.

As illustrated in FIG. 3A, the slider 60 has an insert portion 61 inserted between the peripheral wall portions 25 in the central portion in the width direction. The slider 60 is assembled to bridge between the peripheral wall portions 25 in a state where the insert portion 61 is inserted between the peripheral wall portions 25, and is movable in the center line Ln direction (left-right direction in FIG. 2A) by using the insert portion 61 inserted between the peripheral wall portions 25 as a guide.

In this state, Engagement grooves 62*a* to which the engagement projections 25*a* provided on outer peripheries of the peripheral wall portions 25 are engaged are provided in both side portions of the slider 60 in the width direction along the center line Ln direction, and dropout of the slider 60 from the peripheral wall portions 25 is blocked by the engagement projections 25*a* engaged to the engagement grooves 62*a*.

It should be noted that in the first embodiment, placing the engagement grooves 62*a* along the center line Ln direction prevents the engagement projections 25*a* engaged to the engagement grooves 62*a* from blocking the movement of the slider 60.

Bottomed, tubular accommodation holes 63 each accommodating therein a coil spring 68 and a ball B are formed in both sides of the insert portion 61 to open downward to the polar board 20-side.

The accommodation hole 63 is placed in a position of facing the movable piece 56 supported by the aforementioned support portion 52, and the ball B urged by the coil spring 68 makes pressure contact with the movable piece 56.

Here, as illustrated in FIG. 1B, when a corner portion 43 formed on one end side of the knob 40 is pulled up by a finger (A1 direction in FIG. 1B), a position of the tip end 42*a* swings in a clockwise direction in the circumferential direction around the swinging axis N to cause the slider 60 engaged to the tip end 42*a* to move to the connector portion 23 (the left side in the figure) in the center line Ln direction.

In addition, when the corner portion 43 of the knob 40 is pushed down (A2 direction in FIG. 1B), the position of the tip end 42*a* of the knob 40 swings in a counterclockwise direction in the circumferential direction around the swinging axis N to cause the slider 60 engaged to the tip end 42*a* to move to a side of being separated from the connector portion 23 (the right side in the figure) in the center line Ln direction.

Accordingly, in the first embodiment the slider 60 is provided in such a manner as to move forward/backward in the center line Ln direction in association with an operation of the knob 40, and the position where the ball B makes pressure contact with the movable piece 56 also moves forward/backward in the center line Ln direction in association with the operation of the knob 40.

Next, an operation of the switch device 1 structured as above will be explained.

Here, as illustrated in FIGS. 2A and 2B, the order of the fixed contact point 51, the support portion 52 and the fixed contact point 53 has a reverse relationship between the upper side and the lower side about the center line Ln, and the movable pieces 56 are arranged to be reverse to each other in a right-left relationship in the longitudinal direction.

Therefore, the following explanation will refer to the movement of the movable piece 56 positioned in the upper side about the center line Ln in response to the operation of the knob 40. Since the movement of the movable piece 56 positioned in the lower side about the center line Ln in response to the operation of the knob 40 is in reverse to that of the movable piece 56 positioned in the upper side, the explanation is herein omitted.

Figure 4A:
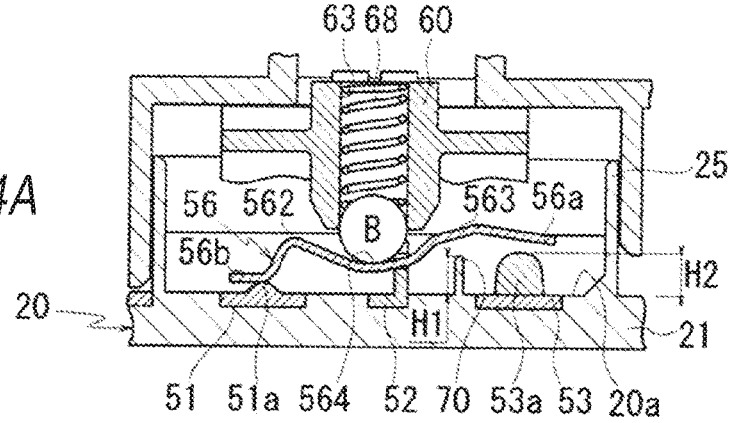
FIGS. 4A to 4C are enlarged views partially illustrating the switch device according to the first embodiment.
Figure 4B:
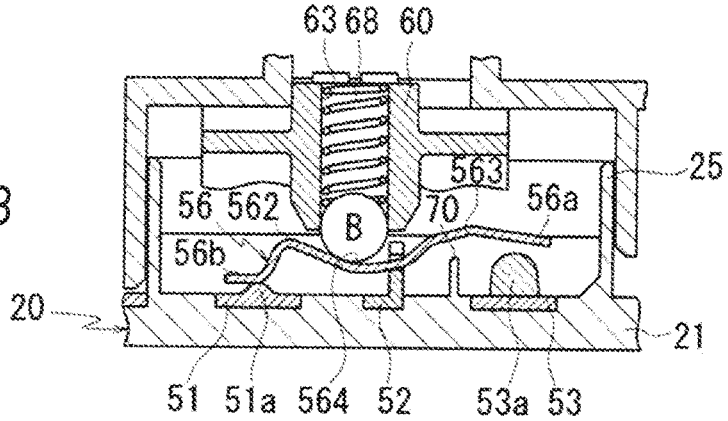
Figure 4C:
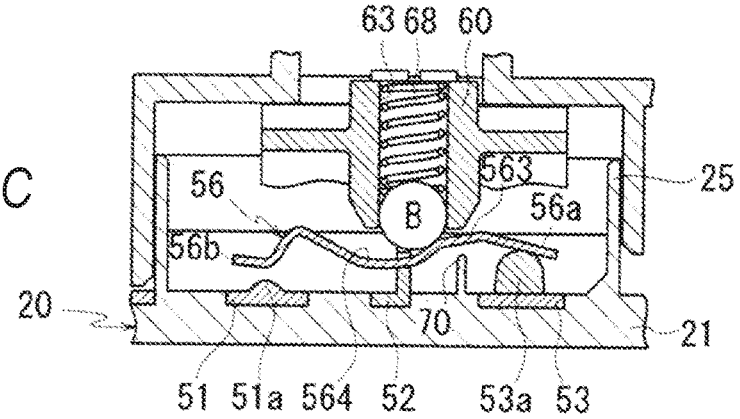

FIGS. 4A to 4*c* are enlarged views partially illustrating the switch device 1, where FIG. 4A illustrates a state where the slider 60 is situated in a neutral position, FIG. 4B illustrates a state where the slider 60 has slid to the connector portion 23, and FIG. 4C illustrates a state where the slider 60 has slid to the opposite side to the connector portion 23.

As illustrated in FIG. 4A, the movable piece 56 supported by the support portion 52 of the polar board 20 is swingably supported in a position of being separated in the upward side of the knob 40 from the upper surface 20*a* of the base portion 21 of the polar board 20.

As illustrated in FIG. 4A, when the knob 40 is situated in a neutral position of being not operated, the ball B makes pressure contact with a region 564 of the movable piece 56 recessed to the polar board 20-side in the midway position in the longitudinal direction thereof, and in this state, the movable piece 56 causes the abutting portion 56*b* to make contact with the fixed contact point portion 51*a* of the fixed contact point 51.

When the corner portion 43 of the knob 40 is pulled up from the state illustrated in FIG. 4A, the slider 60 moves to the connector portion 23 (left side in the figure). As a result, the position of the movable piece 56 with which the ball B makes pressure contact moves toward the curved portion 562 in the abutting portion 56*b* side (refer to FIG. 4B).

Here, in a state where the knob 40 is situated in the neutral position, the abutting portion 56*b* of the movable piece 56 makes contact with the fixed contact point portion 51*a* of the fixed contact point 51. Even if the ball B moves to the abutting portion 56*b*, the state of the movable piece 56 does not change. Accordingly in the same way when the knob 40 is situated in the neutral position, the support portion 52 and the fixed contact point portion 51*a* are held in a state of being conductive to each other through the movable piece 56.

In this case, the electrical contact state between the movable piece 56 and the fixed contact point portion 53*a* does not change to hold the switch-off state.

Next, when the corner portion 43 of the knob 40 is pulled down from the state illustrated in FIG. 4A, the slider 60 moves to a side of being away from the connector portion 23 (right side in the figure). As a result, the position of the movable piece 56 with which the ball B makes pressure contact moves toward the curved portion 563 in the abutting portion 56*a* side (refer to FIG. 4C).

Then, the movable piece 56 is displaced in the clockwise direction around the support point of the support portion 52 to cause the abutting portion 56*a* on one side to abut on the fixed contact point portion 53*a* of the fixed contact point 53 and cause the abutting portion 56*b* on the other side to be disconnected from the fixed contact point portion 51*a* of the fixed contact point 51. Therefore the electrical contact state between the movable piece 56 and the fixed contact point portion 53*a* is switched to be in the switch-on state.

It should be noted that, as described before, the movable piece 56 can slide by a slight gap t3 (refer to FIG. 2C) in the center line Ln direction (left-right direction in FIGS. 4A to 4C) in the support portion 52. Therefore in a point where the abutting portion 65*a* abuts on the fixed contact point portion 53*a*, the movable piece 56 is operated for a pressing force acting from the ball B to cause an abutting point of the abutting portion 56*a* on the fixed contact point portion 53*a* to be displaced in the movement direction (direction of being away from the connector portion 23) of the ball B.

Even if there exist contact blocking objects such as grease or oxide layer covering the abutting portion between the abutting portion 56*a* of the movable piece 56 and the fixed contact point portion 53*a*, the displacement of the abutting point pushes out the contact blocking objects, so that the abutting portion 56*a* of the movable piece 56 can certainly make contact with the fixed contact point portion 53*a*.

Next, a stopper 70 located in the base portion 21 of the polar board 20 will be explained.

As illustrated in FIG. 4A, the stopper 70 is placed between the support portion 52 and the fixed contact point portion 53*a* in the longitudinal direction of the base portion 21. The stopper 70 is formed to be integral with the plastic base portion 21, and extends linearly to the movable piece 56-side in a direction vertical from the base portion 21 to form a wall portion.

As illustrated in FIGS. 4A and 4C, the height H1 of the stopper 70 from the base portion 21 is set such that in a state where repeated use of the switch device 1 does not cause the wear of the fixed contact point portion 53*a*, the movable piece 56 does not abut on the stopper 70 at the time the corner portion 43 is pushed down to cause the movable piece 56 to abut on the fixed contact point portion 53*a*.

Here, when disconnection and disconnection between the movable piece 56 and the fixed contact point portion 52*a* are repeated by an on/off operation of the switch device 1, passage of current between the metallic movable piece 56 and the fixed contact point portion 53*a* generates arc electrical discharge. Therefore while the switch device 1 continues to be used, the arc electrical discharge generated at the connection/disconnection between the movable piece 56 and the fixed contact point portion 53*a* or the contact with the movable contact point 56 gradually promotes the wear of the fixed contact point 53*a* in the power source side.

Figure 5A:
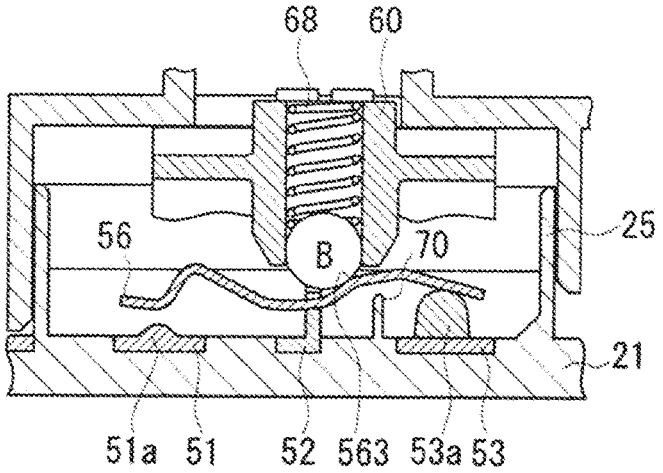
FIGS. 5A and 5B are enlarged views partially illustrating the switch device according to the first embodiment.
Figure 5A:
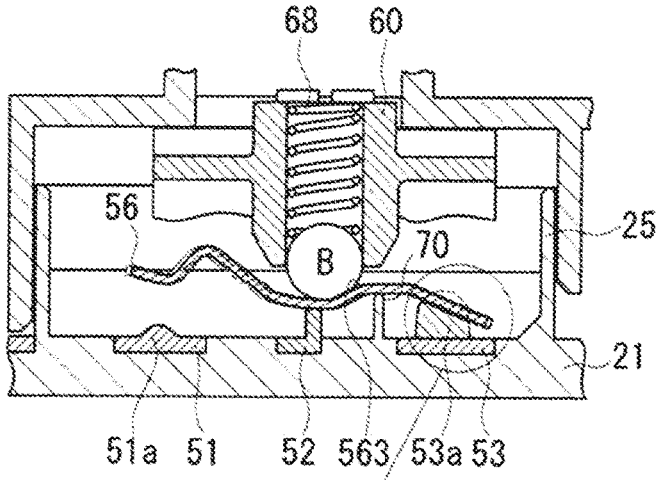
Figure 5B:
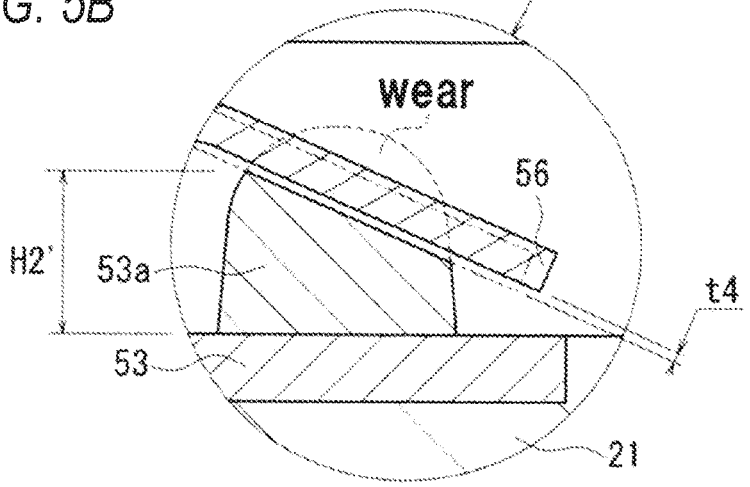

In a point where the height H1 of the stopper 70 from the base portion 21 is set such that the movable piece 56 abuts on the stopper 70 in a point where the height H2 of the fixed contact point portion 53*a* from the base portion 21 becomes a predetermined height (H2') due to wear (refer to FIG. 5B).

When the movable piece 56 abuts on the stopper 70, the movable piece 56 is supported at the longitudinal, predetermined positions in two points of the support portion 52 and the stopper 70.

Here, the movable piece 56 can slide by the slight gap t3 (refer to FIG. 2C) in the center line Ln direction (left-right direction in FIGS. 4A to 4C) in the support portion 52. Therefore in a point where the abutting portion 56*a* abuts on the stopper 70, the movable piece 56 is operated for a pressing force acting from the ball B to cause the abutting point of the abutting portion 56*a* on the stopper 70 to be displaced in the movement direction of the ball B (direction of being away from the connector portion 23).

Therefore when the ball B of the slider 60 presses an inclined surface of the movable piece 56 closer to the curved portion 563, the movable piece 56 slides to the fixed contact point portion 53*a*-side (right side) by the gap t3 between the width t2 of the support portion 52 and the width t1 of the engagement wall 52*b* without swinging (refer to a solid line in FIG. 5B).

Then, the movable piece 56 is away from the fixed contact point portion 53*a* by the sliding amount to cause non-electrical contact between the movable piece 56 and the fixed contact point portion 53*a*.

In the first embodiment, the movable piece 56 is away from the fixed contact point portion 53*a* by the gap t4.

In place of the stopper 70, there may be used a rib provided for preventing the fixed contact point portion 53*a* from being connected to the support portion 52 by wear powder generated by the arc electrical discharge. In this case, the height of the rib from the upper surface 21*a* of the base portion 21 is set such that in a case where the repeated use of the switch device 1 does not cause the wear of the fixed contact point portion 53*a*, the movable piece 56 does not abut on the rib at the time of the abutment between the movable piece 56 and the fixed contact point portion 53*a*, and in a point where the fixed contact point portion 53*a* is worn by the repeated use to reach a predetermined height, the movable piece 56 abuts on the rib.

As described above, in the first embodiment, the switch device 1 is structured such that the band-shaped movable piece 56 is supported in the position of being separated from the opposing surface (upper surface 20*a*) of the polar board 20 to the movable piece 56 by the support portion 52 of the polar board 20 supporting the midway position of the movable piece 56 in the longitudinal direction, the movable piece being provided to be capable of swinging in a direction where the abutting portion 56*a* of the movable piece 56 on the one side in the longitudinal direction and the abutting portion 56*b* on the other side are respectively connected to or disconnected from a first fixed contact point (fixed contact point portion 53*a*) and a second fixed contact point (fixed contact point portion 51*a*) formed to be projected from the upper surface 20*a* of the polar board 20 toward the movable piece 56, and the movable board (slider 60) provided with the urging member (ball B) for urging the movable piece 56 to the polar board 20 is provided to be movable forward/backward in the longitudinal direction in association with the operation of the knob 40, wherein when the slider 60 moves in the longitudinal, one side, the urging position of the movable piece 56 by the ball B is displaced in the longitudinal, one side to cause the abutting portion 56*a* of the movable piece 56 on the one side in the longitudinal direction to make contact with the fixed contact point portion 53*a*, and when the slider 60 moves in the longitudinal, other side, the urging position of the movable piece 56 by the ball B is displaced in the longitudinal, other side to cause the abutting portion 56*a* of the movable piece 56 on the one side in the longitudinal direction to be disconnected from the fixed contact point portion 53*a*. Further, the switch device 1 is structured such that the restriction member (stopper 70) for restricting the movement of the movable piece 56 to the polar board 20 is provided between the support portion 52 of the polar board 20 and the fixed contact point portion 53*a*, the height of the stopper 70 from the polar board 20 being set to the height for abutting on the movable piece 56 in a point where the height of the fixed contact point portion 53*a* from the polar board 20 reaches a predetermined height due to wear, and in the support portion 52 the movable piece 56 is supported to be displaceable in the longitudinal direction of the movable piece 56, wherein when one side of the movable piece 56 makes contact with the fixed contact point portion 53*a*, in a case where the stopper 70 is in contact with the movable piece 56, the movable piece 56 is displaced in the longitudinal direction on a basis of the contact position with the stopper 70 to be disconnected from the fixed contact point portion 53*a*.

With this structure, the stopper 70 is located in the intermediate position between the support portion 52 and the fixed contact point portion 53*a* to extend upward of the base portion 21 from the base portion 21 to limit the movement of the movable piece 56 to the polar board 20.

In addition, the height of the stopper 70 from the base portion 21 is set such that in a point where the height of the fixed contact point portion 53*a* from the base portion 21 reaches the predetermined height H2' by the wear due to the arc electrical discharge generated at the on/off operation of the switch, the stopper 70 abuts on the movable piece 56, and when one side of the movable piece 56 abuts on the stopper 70, in the support portion 52 the movable piece 56 slides in the longitudinal direction, so that the one side of the movable piece 56 is certainly disconnected from the fixed contact point portion 53*a*.

In addition, the predetermined gap t3 (play) that is a difference between the width t2 of the notch portion 561 of the movable piece 56 and the width t1 of the support portion 52 is formed on the support portion of the movable piece 56 by the support portion 52, so that the movable piece 56 can slide by the slight gap t3 (refer to FIG. 2C). Therefore the fixed contact point portion 53*a* is worn, and as a result, in a case where the abutting portion 56*a* abuts on the stopper 70, in a point where the abutting portion 56*a* abuts on the stopper 70, the movable piece 56 is operated for the pressing force acting from the ball B to cause the abutting point of the abutting portion 56*a* on the stopper 70 to be displaced in the movement direction of the ball B (direction of being away from the connector portion 23).

Therefore when the ball B of the slider 60 presses an inclined surface of the movable piece 56 closer to the curved portion 563, the movable piece 56 slides to the fixed contact point portion 53*a*-side (right side) by the gap t3 between the width t2 of the support portion 52 and the width t1 of the engagement wall 52*b* (refer to a solid line in FIG. 5B) without swinging. As a result, it is possible to certainly prevent the contact between the abutting portion 56*a* and the fixed contact point portion 53 side when the fixed contact point portion 53*a* is worn.

In addition, the movable piece 56 slides by the gap t3 in the direction of being away from the fixed contact point portion 53*a* by the pressing force to the fixed contact point portion 53*a*, making it possible to certainly prevent the wear of the fixed contact point portion 53*a* due to the arc electrical discharge.

Also in a case where the stopper 70 is not in contact with the movable piece 56 when one side (fixed contact point portion 53 side) of the movable piece 56 makes contact with the fixed contact point portion 53*a* as described above, the contact position of the movable piece 56 with the fixed contact point portion 53*a* slides in the longitudinal direction.

Therefore even if contact blocking objects such as grease or oxide layer covering the abutting portion between the abutting portion 56*a* of the movable piece 56 and the fixed contact point portion 53*a* exist, the sliding of the contact position acts to push out (chip off) the contact blocking objects, so that the abutting portion 56*a* of the movable piece 56 can certainly make contact with the fixed contact point portion 53*a*.

In addition, the fixed contact point portion 53*a* is formed as a contact point connected to the power source.

With this structure, the arc electrical discharge is generated between the fixed contact point portion 53*a* connected to the power source and the movable piece 56 by the current flowing at the contact. As a result, it is possible to suitably prevent the fixed contact point portion 53*a* from being worn due to the arc electrical discharge.

Next, a switch device 2 according to a second embodiment of the present invention will be explained with reference to FIGS. 6A and 6B.

The switch device 2 according to the second embodiment differs from the switch device 1 according to the first embodiment in a point where a stopper 70A is placed not in a position between the support portion 52 and the fixed contact point portion 53*a*, but in a position of being away from the fixed contact point portion 53*a* as viewed from the support portion 52, and the fixed contact point portion 53*a* is positioned between the support portion 52 and the stopper 70A. It should be noted that a basic structure in the second embodiment other than the stopper 70A is the same as in the first embodiment, and therefore an explanation will be made primarily of the structure, operation and effect of the stopper 70A. The other basic structure will be explained as needed.

Figure 6A:
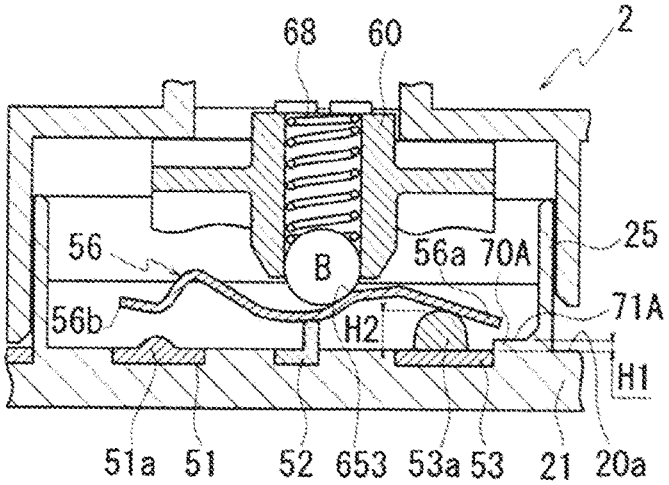
FIGS. 6A and 6B are enlarged views partially illustrating a switch device according to a second embodiment of the present invention.
Figure 6A:
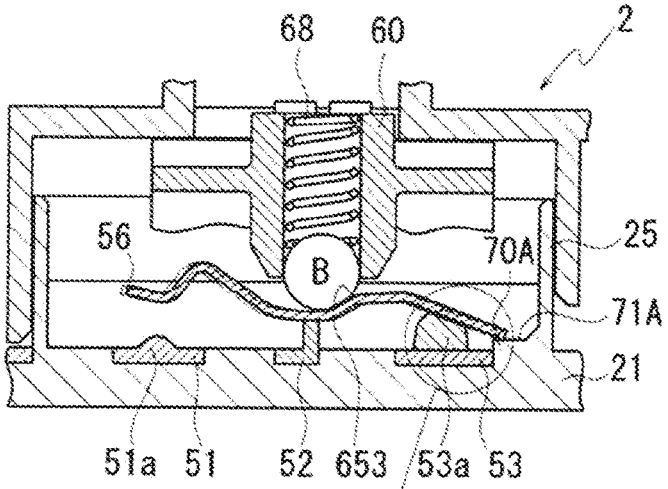
Figure 6B:
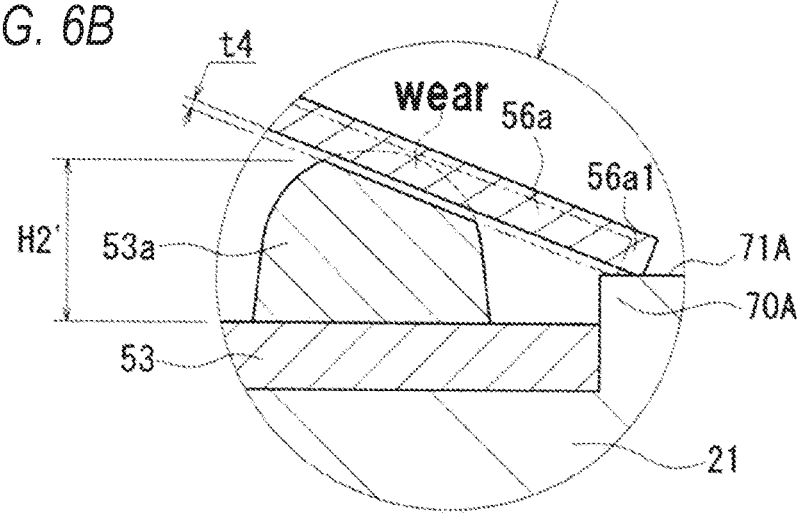
Figure 7B:
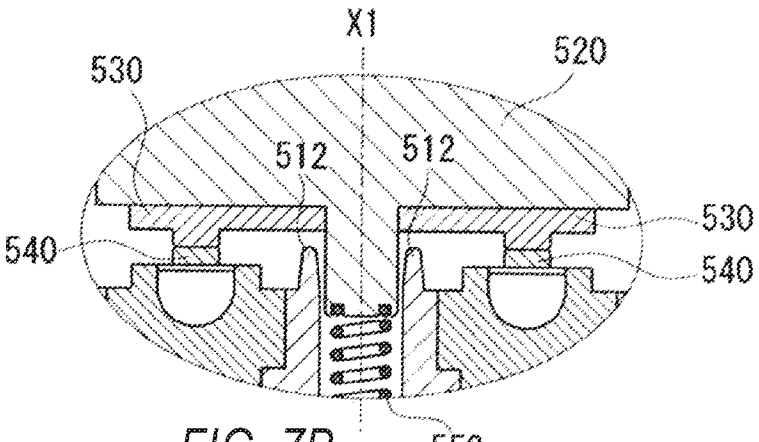
FIGS. 7A to 7C are enlarged views partially illustrating a switch device in a conventional example.
Figure 7C:
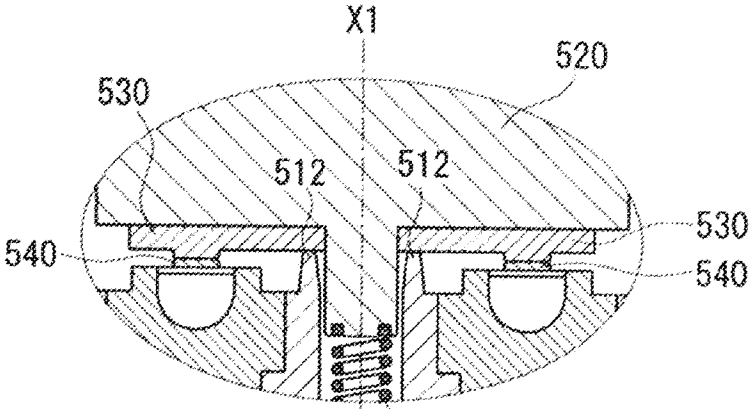
Figure 7A:
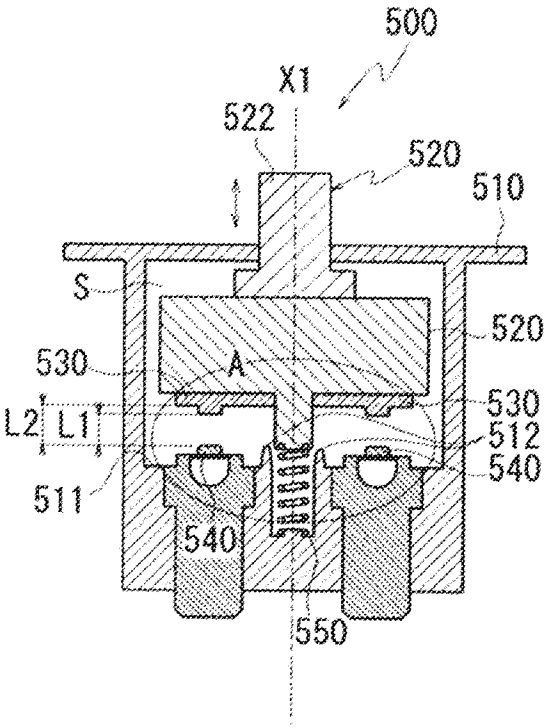

As illustrated in FIG. 6A, the stopper 70A is located in a position closer to the fixed contact point portion 53*a* in a direction of being farther from the support portion 52 than the fixed contact point portion 53*a* and is formed integrally with the plastic peripheral wall portion 25.

The stopper 70A is located in parallel to the upper surface 21*a* of the base portion 21 in a position of being more separate than the upper surface 21*a* of the base portion 21 in the upward direction to the knob 40. The stopper 70A is formed to extend from the lower end of the peripheral wall portion 25 to the boundary to the fixed contact point 53, and an upper surface 71A thereof is formed as a flat surface higher than the base portion 21.

The height H1 of the stopper 70A from the base portion 21 is set such that in a point where the height H2 of the fixed contact point portion 53*a* from the base portion 21 reaches the predetermined height H2' by the wear, a tip 56*a*1 of the abutting portion 56*a* of the movable piece 56 is set to abut on the stopper 70A.

Therefore, with repeated use of the switch, when the fixed contact point portion 53*a* is worn by the arc electrical discharge or by contact with the movable piece 56 to cause the height H2 of the fixed contact point portion 53*a* from the base portion 21 to reach the predetermined height (H2'), the tip 56*a*1 of the abutting portion 56*a* of the movable piece 56 abuts on the stopper 70A at the same time the abutting portion of the movable piece 56 on the fixed contact point portion 53*a* abuts on the fixed contact point portion 53*a*.

Therefore the downward movement of the movable piece 56 to the polar board 20 is limited.

When an end portion of the movable piece 56 closer to the fixed contact point portion 53*a* abuts on the stopper 70A, the movable piece 56 is supported at the longitudinal, predetermined positions in two points of the support portion 52 and the stopper 70A.

Here, the movable piece 56 can slide by the slight gap t3 (refer to FIG. 2C) in the center line Ln direction (left-right direction in FIGS. 4A to 4C) in the support portion 52. Therefore in a point where the abutting portion 56*a* abuts on the stopper 70A, the movable piece 56 is operated for the pressing force acting from the ball B to cause the abutting point of the abutting portion 56*a* on the stopper 70A to be displaced in the movement direction of the ball B (direction of being away from the connector portion 23).

Therefore when the ball B of the slider 60 presses an inclined surface of the movable piece 56 closer to the curved portion 563, the movable piece 56 slides to the fixed contact point portion 53*a* (right side) by the gap t3 between the width t2 of the support portion 52 and the width t1 of the engagement wall 52*b* without swinging (refer to a solid line in FIG. 5B).

Then, the movable piece 56 is away from the fixed contact point portion 53*a* by the sliding amount to cause non-electrical contact between the movable piece 56 and the fixed contact point portion 53*a*.

In the second embodiment, the movable piece 56 is away from the fixed contact point portion 53*a* by the gap t4.

In the second embodiment, the abutting portion of the movable piece 56 on the stopper 70A is formed in a round shape to reduce contact resistance between the movable piece 56 and the stopper 70A. Therefore the movable piece 56 slides smoothly on an upper surface 71A (flat surface) of the stopper 70A, so that the movable piece 56 quickly and certainly leaves the fixed contact point portion 53*a*.

As described above, in the second embodiment, the switch device 1 is structured such that the band-shaped movable piece 56 is supported in the position of being separated from the opposing surface (upper surface 20*a*) of the polar board 20 to the movable piece 56 by the support portion 52 of the polar board 20 supporting the midway position of the movable piece 56 in the longitudinal direction, the movable piece 56 being provided to be capable of swinging in a direction where the abutting portion 56*a* of the movable piece 56 on the one side in the longitudinal direction and the abutting portion 56*b* on the other side are respectively connected to or disconnected from a first fixed contact point (fixed contact point portion 53*a*) and a second fixed contact point (fixed contact point portion 51*a*) formed to be projected from the opposing surface of the polar board 20 to the movable piece 56, and the movable board (slider 60) provided with the urging member (ball B) for urging the movable piece 56 to the polar board 20 is provided to be movable forward/backward in the longitudinal direction in association with the operation of the knob 40, wherein when the slider 60 moves in the longitudinal, one side, the urging position of the movable piece 56 by the ball B is displaced in the longitudinal, one side to cause the abutting portion 56*a* on the one side in the longitudinal direction of the movable piece 56 to make contact with the fixed contact point portion 53*a*, and when the slider 60 moves in the longitudinal, other side, the urging position of the movable piece 56 by the ball B is displaced in the longitudinal, other side to cause the abutting portion 56*a* of the movable piece 56 on the one side in the longitudinal direction to be disconnected from the fixed contact point portion 53*a*. Further, the switch device 1 is structured such that the polar board 20 is provided with the stopper 70A, wherein in a point where the height H2 of the fixed contact point portion 53*a* from the polar board 20 reaches a predetermined height (H2'), the stopper 70A is disposed in the polar board 20 such that an abutting portion of one side of the movable piece 56 does not abut on the fixed contact point portion 53*a*, but a tip side of the movable piece 56 abuts on the stopper 70A to restrict the movement of the one side of the movable piece 56 to the polar board 20-side, and in the support portion 52 the movable piece 56 is supported to be displaceable in the longitudinal direction of the movable piece 56, wherein when the one side of the movable piece 56 makes contact with the fixed contact point portion 53*a*, in a case where the stopper 70A is in contact with the movable piece 56, the movable piece 56 is displaced in the longitudinal direction on a basis of the contact position with the stopper 70A to be disconnected from the fixed contact point portion 53*a*.

With this structure, in a point where the height H2 of the fixed contact point portion 53*a* from the polar board 20 reaches the predetermined height (H2') due to wear, the abutting portion 56*a* of the movable piece 56 abuts on the stopper 70A to restrict the downward movement of the movable piece 56 to the polar board 20.

As a result, in a point where the fixed contact point portion 53*a* is worn by repetition of connection and disconnection between the one side of the movable piece 56 in the longitudinal direction and the first fixed contact point by the operation of the switch device to reach the predetermined height H2', the stopper 70A abuts on the movable piece 56. When the one side of the movable piece 56 abuts on the stopper 70A, in the support portion 52 the movable piece 56 slides in the longitudinal direction, so that the one side of the movable piece 56 is certainly disconnected from the fixed contact point portion 53*a*.

It should be noted that in the aforementioned second embodiment, the stopper 70A is formed as the upper surface 71A (flat surface) in parallel with the base portion 21, but may be inclined upward with leaving the base portion 21.

With this structure, since the movable piece 56 slides to the fixed contact point 67-side and moves upward along the inclined surface of the stopper 70A, it is possible to certainly disconnect the movable piece 56 from the fixed contact point portion 53*a*. Particularly even in a case where the gap t3 between the movable piece 56 and the support portion 52 is small, since the movable piece 56 moves upward of the base portion 21 as well while moving slightly in the longitudinal direction, the movable piece 56 can be certainly disconnected from the fixed contact point portion 53*a*.

In addition, in the embodiments, the stopper 70 (70A) is formed integrally with the base portion 21, but a stopper 70 (70A) formed as a different member on the base portion 21 may be arranged.

With this structure, since a shape of the plastic mold of the plastic base portion 21 is not complicated, the plastic mold can be less expensive.

While only the selected embodiments have been chosen to illustrate the present invention, it will be apparent to those skilled in the art from this disclosure that various changes and modifications can be made therein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A switch device comprising:

a polar board having a first fixed contact point, a second fixed contact point, a support portion, and a restriction member between the support portion and the first fixed contact point;

a band-shaped movable piece supported in a position of being separated from an opposing face of the polar board by the support portion at a midway position of the movable piece in a longitudinal direction, the movable piece being provided to be capable of swinging in a direction where one side and another side of the movable piece in the longitudinal direction are connected to or disconnected from the first fixed contact point and the second fixed contact point formed to be projected toward the movable piece from the opposing face of the polar board; and a movable board having an urging member for urging the movable piece to the polar board, the movable board being movable forward/backward in the longitudinal direction in association with an operation of a knob;

wherein when the movable board moves forward in the longitudinal direction, the urging member causes the one side of the movable piece in the longitudinal direction to make contact with the first fixed contact point, and when the movable board moves backward in the longitudinal direction, the urging member causes the one side of the movable piece in the longitudinal direction to be disconnected from the first fixed contact point;

wherein the restriction member is provided to restrict the movement of the movable piece to the polar board, the restriction member having a set height from the polar board such that the restriction member abuts on the movable piece at a point where a height of the first fixed contact point from the polar board reaches a predetermined height due to wear; and wherein the movable piece is supported by the support portion to be displaceable in the longitudinal direction such that when the one side of the movable piece makes contact with the first fixed contact point, in a case where the restriction member makes contact with the movable piece, the movable piece is displaced in the longitudinal direction on a basis of the contact position with the restriction member to be disconnected from the first fixed contact point.

2. The switch device according to claim 1, wherein:

notch portions are formed on both sides of the movable piece in a width direction and in the midway position of the movable piece in the longitudinal direction, wherein engagement portions provided in the support portion are engaged to the notch portions, and a width of the notch portion is set to be larger than the width of the engagement portion in the longitudinal direction, so that in the support portion, the movable piece is supported to be displaceable in the longitudinal direction of the movable piece.

3. The switch device according to claim 1, wherein the first contact point includes a contact point connected to a power source.

4. The switch device according to claim 1, wherein an abutting portion of the movable piece on the restriction member is subjected to rounding processing.

5. A switch device comprising:

a polar board having a first fixed contact point, a second fixed contact point, a support portion, and a restriction member between the support portion and the first fixed point;

a band-shaped movable piece supported in a position of being separated from an opposing face of the polar board by the support portion at a midway position of the movable piece in a longitudinal direction, the movable piece being provided to be capable of swinging in a direction where one side and another side of the movable piece in the longitudinal direction are connected to or disconnected from the first fixed contact point and the second fixed contact point formed to be projected toward the movable piece from the opposing face of the polar board; and a movable board having an urging member for urging the movable piece to the polar board, the movable board being movable forward/backward in the longitudinal direction in association with an operation of a knob;

wherein when the movable board moves forward in the longitudinal direction, the urging member causes the one side of the movable piece in the longitudinal direction to make contact with the first fixed contact point, and when the movable board moves backward in the longitudinal direction, the urging member causes the one side of the movable piece in the longitudinal direction to be disconnected from the first fixed contact point;

wherein in a point where a height of the first fixed contact point from the polar board reaches a predetermined height due to wear, the restriction member abuts not on an abutting portion of the one side of the movable piece on the first fixed contact point but on a tip side of the movable piece to restrict the movement of the one side of the movable piece to the polar board; and wherein the movable piece is supported by the support portion to be displaceable in the longitudinal direction such that when the one side of the movable piece makes contact with the first fixed contact point, in a case where the restriction member makes contact with the movable piece, the movable piece is displaceable in the longitudinal direction on a basis of the contact position with the restriction member to be disconnected from the first fixed contact point.

6. The switch device according to claim 2, wherein:

notch portions are formed on both sides of the movable piece in the width direction and in the midway position of the movable piece in the longitudinal direction, wherein engagement portions provided in the support portion are engaged to the notch portions, and a width of the notch portion is set to be larger than the width of the engagement portion in the longitudinal direction, so that in the support portion, the movable piece is supported to be displaceable in the longitudinal direction of the movable piece.

7. The switch device according to claim 2, wherein the first contact point includes a contact point connected to a power source.

8. The switch device according claim 2, wherein an abutting portion of the movable piece on the restriction member is subjected to rounding processing.

* * * * *